US007722034B2

(12) United States Patent
Kosuda et al.

(10) Patent No.: US 7,722,034 B2
(45) Date of Patent: May 25, 2010

(54) SHEET DISCHARGE TRAY, AS WELL AS SHEET CONVEYING APPARATUS, IMAGE FORMING APPARATUS, AND IMAGE READING APPARATUS HAVING THE SHEET DISCHARGE TRAY

(75) Inventors: Shigeru Kosuda, Kawaguchi (JP); Jun Tanaka, Chichibu (JP)

(73) Assignee: Canon Denshi Kabushiki Kaisha, Chichibu-Shi (JP)

( * ) Notice: Subject to any disclaimer, the term of this patent is extended or adjusted under 35 U.S.C. 154(b) by 78 days.

(21) Appl. No.: 11/853,466

(22) Filed: Sep. 11, 2007

(65) Prior Publication Data

US 2008/0067737 A1 Mar. 20, 2008

(30) Foreign Application Priority Data

Sep. 14, 2006 (JP) ..... 2006-249557

(51) Int. Cl.
*B65H 31/20* (2006.01)

(52) U.S. Cl. ..... 271/223; 271/213; 271/207; 271/209; 399/405

(58) Field of Classification Search ..... 271/213, 271/207, 220, 223; 399/405
See application file for complete search history.

(56) References Cited

U.S. PATENT DOCUMENTS

| | | | | |
|---|---|---|---|---|
| 6,070,868 | A * | 6/2000 | Nagato et al. | 271/145 |
| 6,701,841 | B2 * | 3/2004 | Tsurumaki | 101/419 |
| 7,484,729 | B2 * | 2/2009 | Ono et al. | 271/209 |
| 2006/0017219 | A1 * | 1/2006 | Yamada | 271/209 |
| 2006/0018693 | A1 * | 1/2006 | Nobe et al. | 399/405 |

FOREIGN PATENT DOCUMENTS

| | | |
|---|---|---|
| JP | 10-109807 | 4/1998 |
| JP | 2004-010220 | 1/2004 |

* cited by examiner

*Primary Examiner*—Patrick H Mackey
*Assistant Examiner*—Ernesto Suarez
(74) *Attorney, Agent, or Firm*—Fitzpatrick, Cella, Harper & Scinto

(57) ABSTRACT

A sheet discharge tray that can improve width direction alignment of discharged sheets of various sizes with a simple structure. Ribs are disposed on a sheet discharge tray. And a space between at least a pair of adjacent ribs among the ribs at a discharging direction upstream end portion is narrower than a space between the at least two adjacent ribs at a discharging direction downstream end portion.

12 Claims, 8 Drawing Sheets

SHEET DISCHARGE TRAY, AS WELL AS SHEET CONVEYING APPARATUS, IMAGE FORMING APPARATUS, AND IMAGE READING APPARATUS HAVING THE SHEET DISCHARGE TRAY

BACKGROUND OF THE INVENTION

1. Field of the Invention

The present invention relates to a sheet discharge tray, and more particularly to a sheet discharge tray that stacks sheets such as originals, printing paper, or plastic sheets discharged from a sheet conveying apparatus that conveys sheets and is provided in an image forming apparatus, such as a copying machine or a printer, an image reading apparatus, such as a sheet feed scanner, etc., as well as a sheet conveying apparatus, a image forming apparatus, and an image reading apparatus having the sheet discharge tray.

2. Description of the Related Art

A sheet conveying apparatus that conveys sheets is provided in an image forming apparatus, such as a copying machine or a printer, and an image reading apparatus, such as a sheet feed scanner. This kind of sheet conveying apparatus discharges conveyed sheets onto the stacking surface of a sheet discharge tray provided in the image forming apparatus or the image reading apparatus. Some sheet discharge trays are provided with an extension tray, described later using FIG. 9, in order to stack large size sheets that are discharged from the sheet conveying apparatus (for example, see Japanese Laid-Open Patent Publication (Kokai) No. 2004-010220 (FIG. 2)).

FIG. 9 is a side view showing schematic configuration of a conventional sheet discharge tray.

In FIG. 9, a sheet discharge tray 10 comprises a plate-shaped member 11 on which a stacking surface 11*a* is formed for stacking sheets discharged from sheet discharge section 20 of a sheet conveying apparatus, an extension tray 12 comprising a plate-shaped member, on which an extension stacking surface 12*a* is formed, that is capable of face-to-face superposition with the stacking surface 11*a*, and a pivot 13 that is provided between the plate-shaped member 11 and the extension tray 12. The pivot 13 is provided in proximity to the end of the stacking surface 11*a* in the discharging direction. The plate-shaped member 11 rotatably supports the extension tray 12 via the pivot 13.

The extension tray 12 arrives at a housing position (not shown) by being rotated in the direction of an arrow D shown in FIG. 9. At the housing position, the extension stacking surface 12*a* of the extension tray 12 is opposite to the stacking surface 11*a* of the plate-shaped member 11. When the extension tray 12 is in the housing position, a sheet of a size that is smaller than the length in the discharging direction of the stacking surface 11*a*, such as a business card or a postcard, can be stacked on the surface opposite to the extension stacking surface 12*a* of the extension tray 12, i.e. the rear surface. In contrast, when stacking sheets that are longer than the length in the discharging direction of the stacking surface 11*a*, the extension tray 12 is rotated in the opposite direction to the arrow D to reach the extension position shown in FIG. 9.

According to the sheet discharge tray 10 shown in FIG. 9, the length of the stacking surface of the sheet discharge tray 10 can be changed depending on the size of the sheets to be discharged from the sheet discharge section 20 of the sheet conveying apparatus.

As described later using FIG. 10, a sheet discharge tray that stacks sheets discharged from a sheet conveying apparatus while aligning the sheets has also been proposed (for example, see Japanese Laid-Open Patent Publication (Kokai) No. 10-109807 (FIG. 1)).

FIG. 10 is a side view showing schematic configuration of another conventional sheet conveying apparatus in which a sheet discharge section is provided.

A sheet discharge tray 30 that is connected to a sheet conveying apparatus 300 as shown in FIG. 10 comprises a base 31 on which are formed a sloping surface 31*a* and a horizontal surface 31*b* for stacking sheets discharged from sheet discharge section 320 of the sheet conveying apparatus 300, a first end fence 32 provided at the end in the discharging direction of the base 31, two ribs 35 that are vertically arranged in parallel in the discharging direction on the upper surface of the base 31, and a second end fence 33 as a abutment plate that is provided between the two ribs 35. The second end fence 33 may also be configured to be movable in the discharging direction.

According to the sheet discharge tray 30 shown in FIG. 10, since the sloping surface 31*a* is formed to become lower as it proceeds towards the end side in the discharging direction, through the force of gravity, the sheets can be stacked so as to collide against either the end fence 32 or the end fence 33 depending on the sheet size. It is therefore possible to reduce misalignment among the discharged sheets in the discharging direction.

Further, in a case where the size of the discharged sheets is small, since the inside faces of the ribs 35 contact the sheets before the sheets collide against the end fence 33, the ribs 35 can function as widthwise regulating plates that reduce misalignment among sheets with regard to the width direction that is orthogonal to the discharging direction.

According to the sheet discharge tray 10 shown in FIG. 9, an improvement in the discharging direction alignment of sheets can be expected by forming a sloping surface in which the stacking surface 11*a* and the extension stacking surface 12*a* become lower as they approach the sheet discharge section 20. However, an improvement in the alignment of sheets in the width direction that is orthogonal to the discharging direction can not be expected. It is thus necessary for the user to remove a bundle of sheets that is stacked on the sheet discharge tray 10 and correct the misalignment in the width direction.

Further, according to the sheet discharge tray 30 shown in FIG. 10, an improvement in the discharging direction alignment of discharged sheets can be expected when the user adjust the position in the discharging direction of the second end fence 33 to match the size of discharged sheets. However it is necessary for the user to consume time to adjust the position of the second end fence 33. Furthermore, according to the sheet discharge tray 30 shown in FIG. 10, since a sheet whose width exceeds the space between the two ribs 35 is stacked on the upper surface of the ribs 35, an improvement in the width direction alignment of such sheets can not be expected. Therefore, when large size sheets are discharged, the user must perform the time consuming work of removing a bundle of sheets that are stacked in a disorderly manner on the sheet discharge tray 30 and then aligning the bundle of sheets.

SUMMARY OF THE INVENTION

The present invention provides a sheet discharge tray that can improve width direction alignment of discharged sheets of various sizes with a simple structure, and another sheet discharge tray that can improve discharging direction alignment and width direction alignment of discharged sheets of various sizes with a simple structure, as well as a sheet conveying apparatus, a image forming apparatus, and an image reading apparatus having the sheet discharge tray.

According to a first aspect of the present invention, there is provided a sheet discharge tray having a stacking surface adapted to stack sheets that are discharged in a discharging direction from a sheet discharge section of a sheet conveying apparatus adapted to convey sheets, comprising at least two ribs which are disposed on the stacking surface and are elongate substantially in the discharging direction, wherein, the at least two ribs are arranged respectively such that a space with respect to a width direction that is orthogonal to the discharging direction between at least a pair of adjacent ribs among the at least two ribs at a discharging direction upstream end portion is narrower than a space with respect to the width direction between the at least a pair of adjacent ribs at a discharging direction downstream end portion.

According to a first aspect of the present invention, ribs are disposed on a sheet discharge tray. And a space between at least a pair of adjacent ribs among the ribs at a discharging direction upstream end portion is narrower than a space between the at least two adjacent ribs at a discharging direction downstream end portion. It is thereby possible to improve width direction alignment of discharged sheets with a simple structure. As a result, the time and labor required of a user to align a bundle of sheets that is stacked on the sheet discharge tray can be reduced.

According to a second aspect of the present invention, there is provided a sheet discharge tray having a stacking surface adapted to stack sheets that are discharged in a discharging direction from a sheet discharge section of a sheet conveying apparatus adapted to convey sheets, comprising an extension tray comprising a plate-shaped member on which is formed an extension stacking surface for extending the stacking surface in the discharging direction, a pivot adapted to make the extension tray rotatable between a first position at which the extension stacking surface is opposite to the stacking surface and a second position for extending the stacking surface, at least two first ribs which are disposed on the extension stacking surface and are elongate substantially in the discharging direction, and at least two second ribs which are disposed on a surface of the extension tray opposite to the extension stacking surface and are elongate substantially in the discharging direction, wherein, when the extension tray is at the second position, the first ribs are arranged respectively such that an upper end of a discharging direction downstream end portion thereof is higher than an upper end of a discharging direction upstream end portion thereof, whereas, when the extension tray is at the first position, the second ribs are arranged respectively such that an upper end of a discharging direction downstream end portion thereof is higher than an upper end of a discharging direction upstream end portion thereof.

According to a second aspect of the present invention, first ribs and second ribs are disposed on an extension tray. It is thereby possible to improve discharging direction alignment and width direction alignment of discharged sheets with a simple structure. As a result, the time and labor required of a user to align a bundle of sheets that is stacked on the sheet discharge tray can be reduced.

According to a third aspect of the present invention, there is provided a sheet discharge tray having a stacking surface adapted to stack sheets that are discharged in a discharging direction from a sheet discharge section of a sheet conveying apparatus adapted to convey sheets, comprising an extension tray comprising a plate-shaped member on which is formed an extension stacking surface for extending the stacking surface in the discharging direction, a pivot adapted to make the extension tray rotatable between a first position at which the extension stacking surface is opposite to the stacking surface and a second position for extending the stacking surface, and at least two ribs which are disposed on a surface of the extension tray opposite to the extension stacking surface and are elongate substantially in the discharging direction, wherein, when the extension tray is at the first position, the at least two ribs are arranged respectively such that an upper end of a discharging direction downstream end portion thereof is higher than an upper end of a discharging direction upstream end portion thereof.

According to a fourth aspect of the present invention, there is provided a sheet conveying apparatus comprising the sheet discharge tray.

According to a fifth aspect of the present invention, there is provided an image reading apparatus comprising the sheet discharge tray.

According to a sixth aspect of the present invention, there is provided an image forming apparatus comprising the sheet discharge tray.

Further features of the present invention will become apparent from the following description of exemplary embodiments with reference to the attached drawings.

DESCRIPTION OF THE EMBODIMENTS

Figure 1:
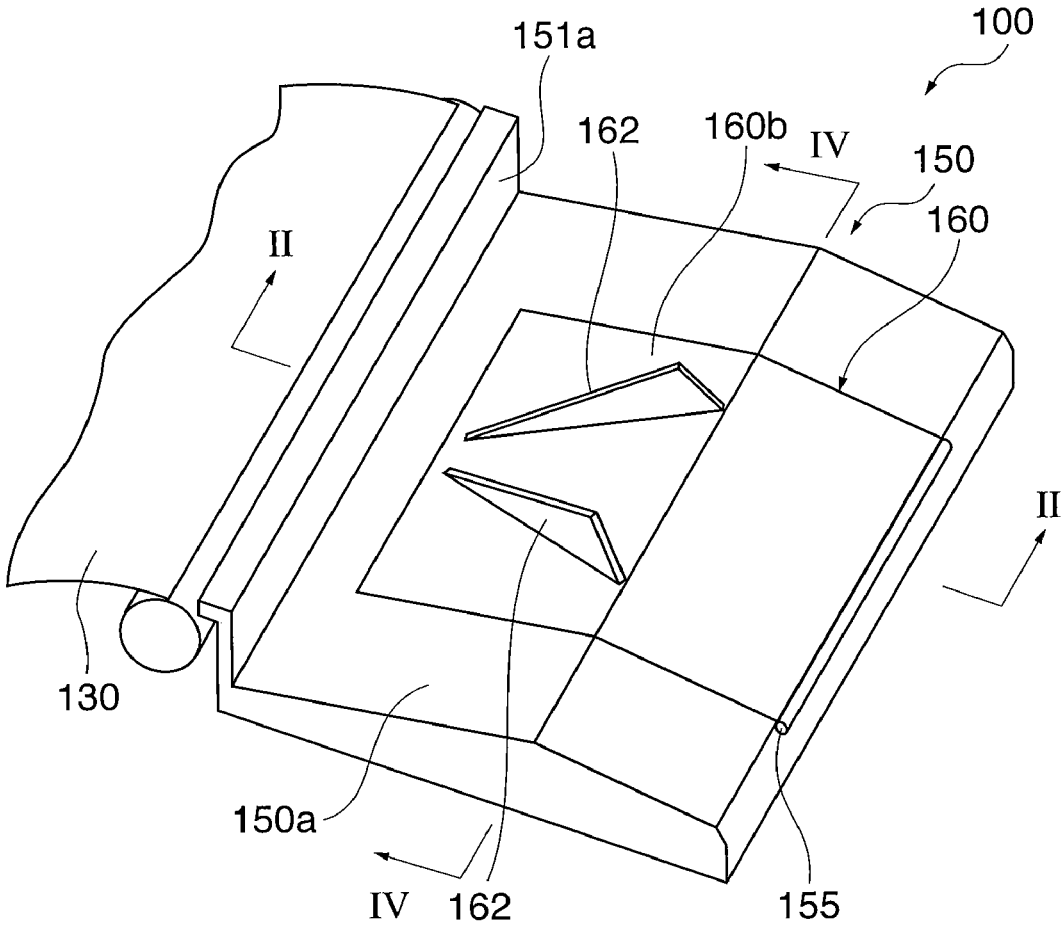
FIG. 1 is a perspective view showing schematic configuration of a sheet discharge section and a stacking section of a scanner comprising a sheet discharge tray according to an embodiment of the present invention.

The present invention will now be described in detail with reference to the drawings showing preferred embodiments thereof. It should be noted that the relative arrangement of the components, the numerical expressions and numerical values set forth in these embodiments do not limit the scope of the present invention unless it is specifically stated otherwise.

Hereunder, an embodiment of the present invention is described in detail while referring to the drawings.

Figure 2:
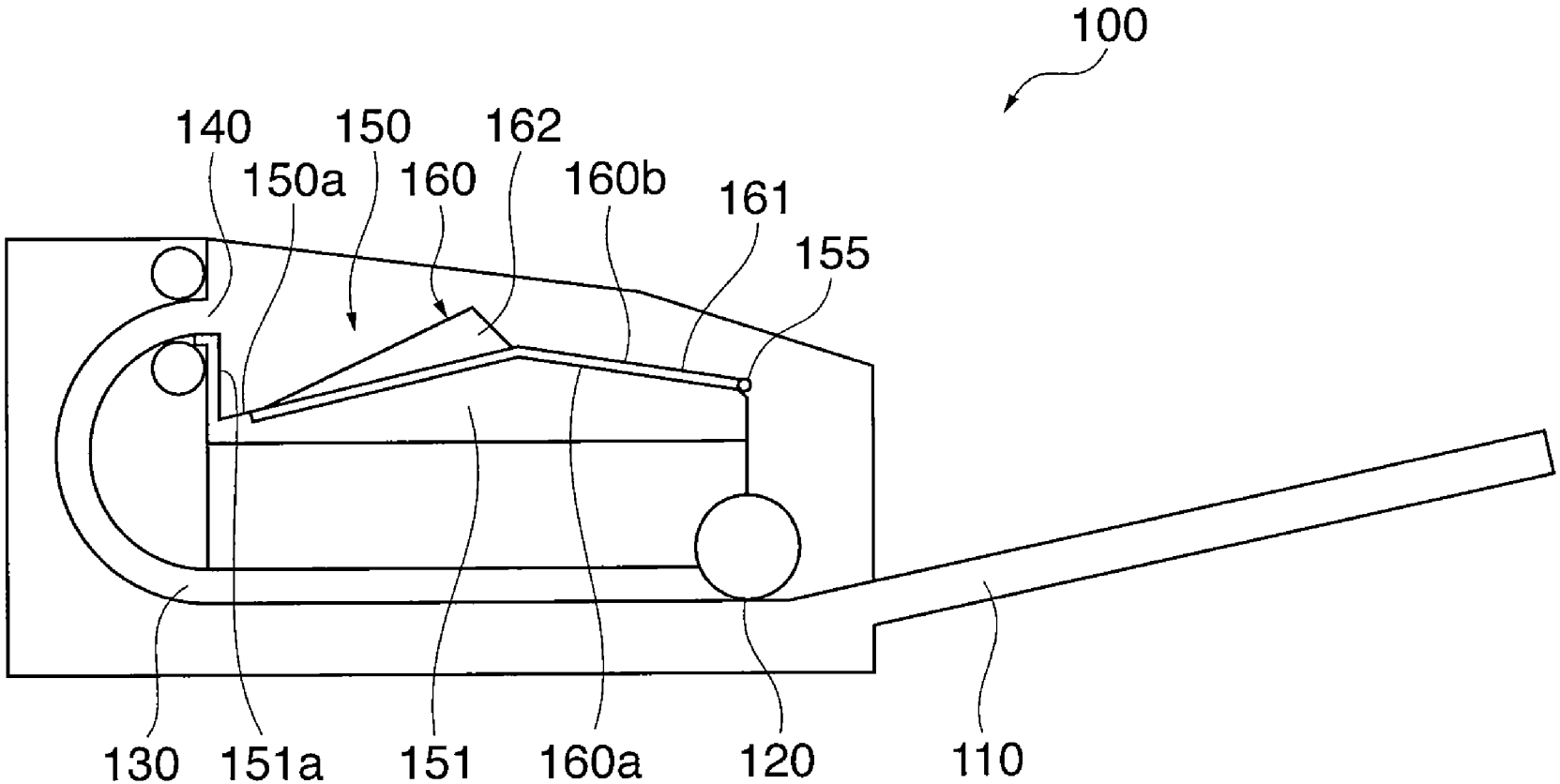
FIG. 2 is a cross-sectional view of the scanner taken on line II-II of FIG. 1.
Figure 3A:
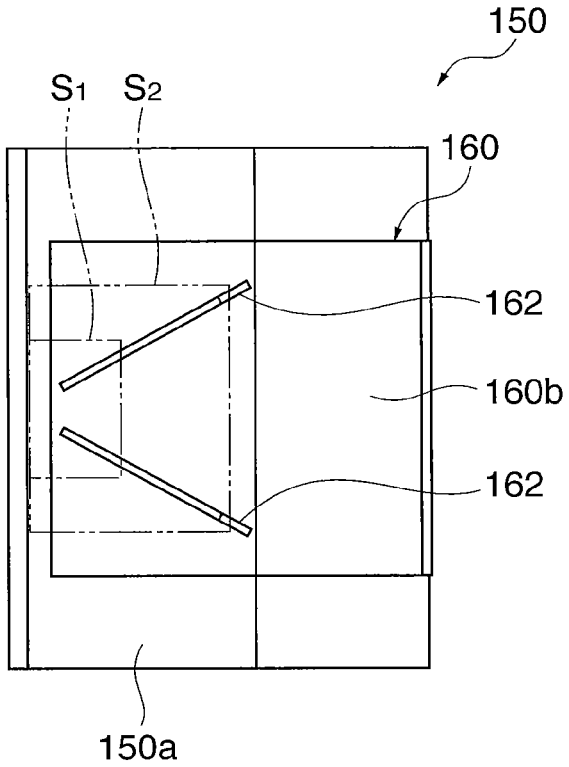
FIG. 3A is a top view of the stacking section of the scanner.

FIG. 1 is a perspective view showing schematic configuration of a sheet discharge section and a stacking section of a scanner comprising a sheet discharge tray according to an embodiment of the present invention. FIG. 2 is a cross-sectional view of the scanner taken on line II-II of FIG. 1. FIG. 3A is a top view of the stacking section of the scanner.

In FIG. 1 and FIG. 2, a scanner 100 that reads an image on a sheet being conveyed comprises a sheet feed tray 110 that stacks a sheet bundle consisting of a plurality of sheets, feeding section 120 that feeds sheets while separating the sheets, one by one, from the sheet bundle, conveying section 130 that conveys sheets that are fed from the feeding section 120 along a conveying path, image reading section (not shown) that reads images of sheets being conveyed in the conveying path, sheet discharge section 140 that discharges sheets conveyed by the conveying section 130, and a sheet discharge tray 150 including a base 151 on which is formed a stacking surface 150*a* that stacks discharged sheets.

Next, an image reading operation that is executed by the scanner 100 shown in FIG. 1 to FIG. 3A is described.

The feeding section 120 separates sheets, one by one, from a bundle of sheets that is stacked on the sheet feed tray 110 and feeds the separated sheets to the image reading section via the conveying path of the conveying section 130. At the image reading section, a light source irradiates a light on a sheet that is being conveyed and an image sensor receives light that is reflected from the sheet in question to read an image on the sheet. The image information that is read is conveyed to unshown image processing section. In this connection, a sheet from which the image reading section reads an image may be any kind of original, such as a recording sheet made with an OA sheet, a receipt, or a check. Even in a case where multiple kinds of originals are mixed, as long as the sizes of the originals are substantially the same the alignment of originals according to the present invention is favorable.

After the above described image reading operation is performed, the sheets pass through the conveying path of the conveying section 130 and are discharged onto the stacking surface 150*a* by the sheet discharge section 140.

Next, the sheet discharge tray 150 shown in FIG. 1 to FIG. 3A is described in detail.

As shown in FIG. 1 and FIG. 2, the stacking surface 150*a* of the sheet discharge tray 150 is a sloping surface which forms a predetermined angle with the horizontal plane so as to one side of the stacking surface 150*a* is lower in the discharging direction than the other side. A discharged bundle of small size sheets are stacked on sloping ribs 162, described later, and the sloping stacking surface 150*a*, such that the trailing ends of the sheets in the discharging direction collide with a wall surface 151*a* that is arranged in a substantially perpendicular direction at an end portion of the base 151 near the sheet discharge section 140 to thereby align the discharged bundle of sheets. As shown in FIG. 3A, the length in the discharging direction of the sloping surface of the stacking surface 150*a* is set to a length that can stack small size sheets such as a business card size sheet $S_1$ or a postcard size sheet $S_2$. It is thus possible to stack small size sheets on the stacking surface 150*a* and the ribs 162 even without extending the extension tray 160 to the extension position.

The sheet discharge tray 150 includes an extension tray 160 on which an extension stacking surface 160*a* is formed for extending the stacking surface 150*a*, and a pivot 155 that is provided between the stacking surface 150*a* and the extension stacking surface 160*a*. The pivot 155 is provided near the end of the stacking surface 150*a* in the discharging direction. The base 151 of the sheet discharge tray 150 rotatably supports the extension tray 160 via the pivot 155.

FIG. 1 to FIG. 3A show the sheet discharge tray 150 in a stored state in which the extension tray 160 is rotated to reach a housing position at which the stacking surface 150*a* is opposite to the extension stacking surface 160*a*. At this time, a stacking surface 160*b* that is the rear side of the extension stacking surface 160*a* of the extension tray 160 forms a substantially complementary shape to the stacking surface 150*a* and serves as a substitute for at least one portion of the stacking surface 150*a* (see FIG. 1 and FIG. 3A). Further, the length in the discharging direction of the extension stacking surface 160*a* and the stacking surface 160*b* is substantially equal to the length in the discharging direction of the stacking surface 150*a*.

The extension tray 160 comprises a base 161 and two ribs 162 that are disposed on the stacking surface 160*b* of the base 161.

Although according to the present embodiment the ribs 162 are formed in a shape that is substantially triangular when viewed from the side, the shape of the ribs is not limited thereto. A feature of the present invention is that the height of the upper end of the ribs 162 is arranged to be lower at the end portion near the sheet discharge section 140 (upstream side in the discharging direction) than the height at the discharging direction downstream end portion. Thus, discharged sheets are moved towards the sheet discharge section 140 on the base 151 along the sloping surface of the upper end of the ribs 162 by the force of gravity. Then the trailing ends of the sheets stacked on the ribs 162 collide with the wall surface 151*a* to thereby align the discharged sheets. As a result, in comparison to a case of extending the extension tray 160 to stack discharged sheets on the stacking surface 150*a*, particularly for small size sheets it is possible to more surely prevent discharged sheets from being scattered in the discharging direction on the stacking surface 150*a*. Thus, the discharging direction alignment of discharged sheets can be improved.

Figure 4:
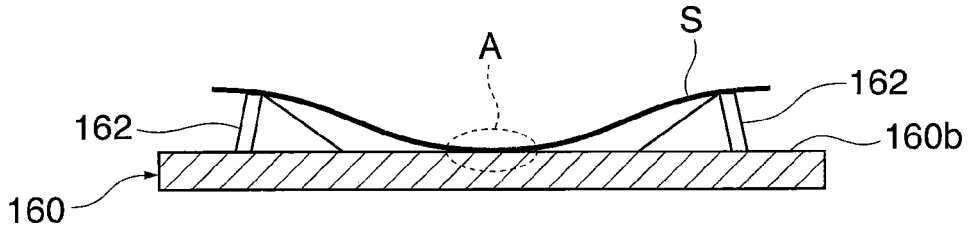
FIG. 4 is a cross-sectional view taken on line IV-IV of FIG. 1, showing the state of a sheet that is stacked on the extension tray shown in FIG. 1 when the extension tray is in a housing position.

Further, as shown in FIG. 1 and FIG. 3A, the two ribs 162 are arranged in a substantially divergent layout on the stacking surface 160*b*. More specifically, the space between the two ribs 162 at the end portion near the sheet discharge section 140 is narrower than the space at the discharging direction downstream end portion with respect to the width direction that is orthogonal to the discharging direction. As a result, as shown by the region A in FIG. 4, when the extension tray 160 is in the housing position, depending on the space between the two ribs 162, a deflection occurs at the center part in the width direction of a sheet S that is stacked on the top of the stacking surface 150*a* and also on the top surface of the ribs 162. The deflection deformation volume differs with regard to the discharging direction. More specifically, the deflection is noticeably larger at the leading end in the discharging direction of the sheet S than at the trailing end thereof. Such difference in the deflection deformation volume is assured by the fact that the angle formed between the upper end of the ribs 162 and the horizontal plane is greater than the angle formed between the stacking surface 150*a* and the horizontal plane. Because of this deflection, scattering of sheets in the width direction is controlled by the upper end of the ribs 162 at the leading ends of the sheets in the discharging direction in particular. Further, the two side edges of the sheets move toward the center of the sheets because of the deflection. As a result, the width direction alignment of discharged sheets can be improved. It is therefore possible to reduce the time and labor required of a user to align the sides of a bundle of sheets that are stacked on the sheet discharge tray. Further, since the aforementioned deflection reduces the area of contact portion of a discharging sheet at which a discharging sheet contacts with a sheet that is already stacked on the sheet discharge tray 150, the friction force that acts between these sheets decreases. Consequently, it is also possible to prevent deterioration in alignment caused by push-out of a sheet that is already stacked.

As described above, the discharging direction alignment of sheets is ensured by the sheets colliding with the wall surface 151*a* of the base 151.

Figure 10:
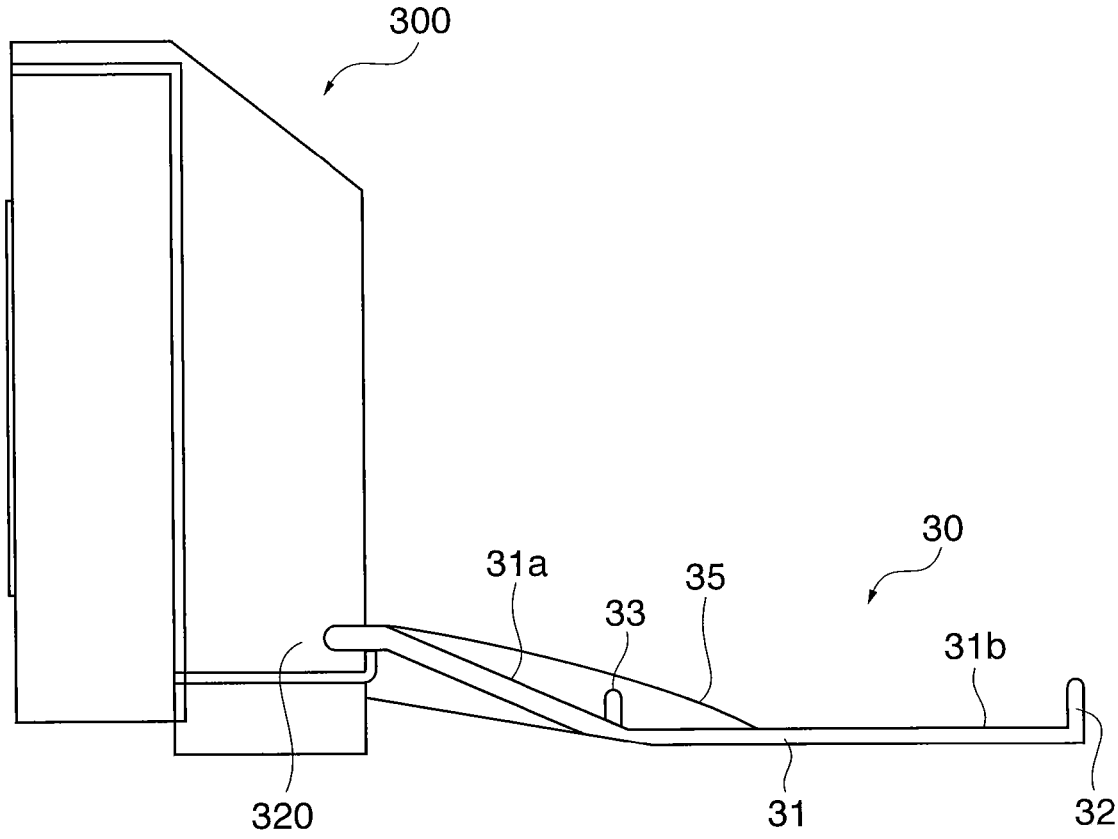
FIG. 10 is a side view showing schematic configuration of another conventional sheet conveying apparatus in which a sheet discharge section is provided.

It is therefore possible to omit the installation of the end fence 33 as an abutment plate and the ribs 35 as widthwise regulating plates shown in FIG. 10.

Next, the stacking of sheets when the extension tray 160 is in the extension position is described.

When a sheet to be discharged from the sheet discharge section 140 has a larger size than the aforementioned sheets $S_1$, and $S_2$, for example, a B4 size or A3 size sheet $S_3$, is to be stacked on the stacking surface 150*a*, the extension tray 160 is rotated in the direction indicated by the arrow B shown in FIG. 6, described later, to place the extension tray 160 in the extension position. As a result, an extended stacking surface is formed that includes the stacking surface 150*a* and the extension stacking surface 160*a*.

Figure 5:
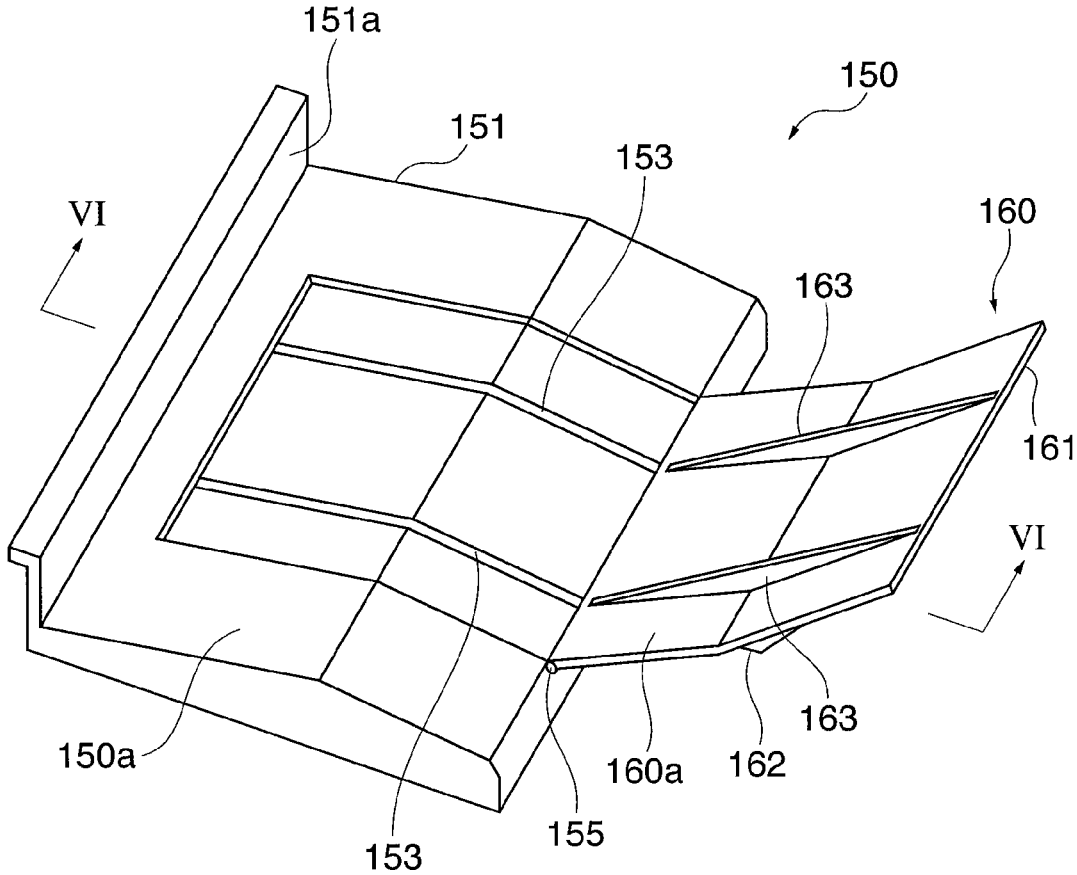
FIG. 5 is a perspective view showing the state of the stacking section of the scanner when the extension tray shown in FIG. 1 is extended to the extension position.

FIG. 5 is a perspective view showing the state of the stacking section of the scanner 100 when the extension tray 160 is extended to the extension position. FIG. 6 is a cross-sectional view of the scanner 100 taken on line VI-VI of FIG. 5. FIG. 7 is a top view of the stacking section of the scanner 100 in the state shown in FIG. 6.

Figure 6:
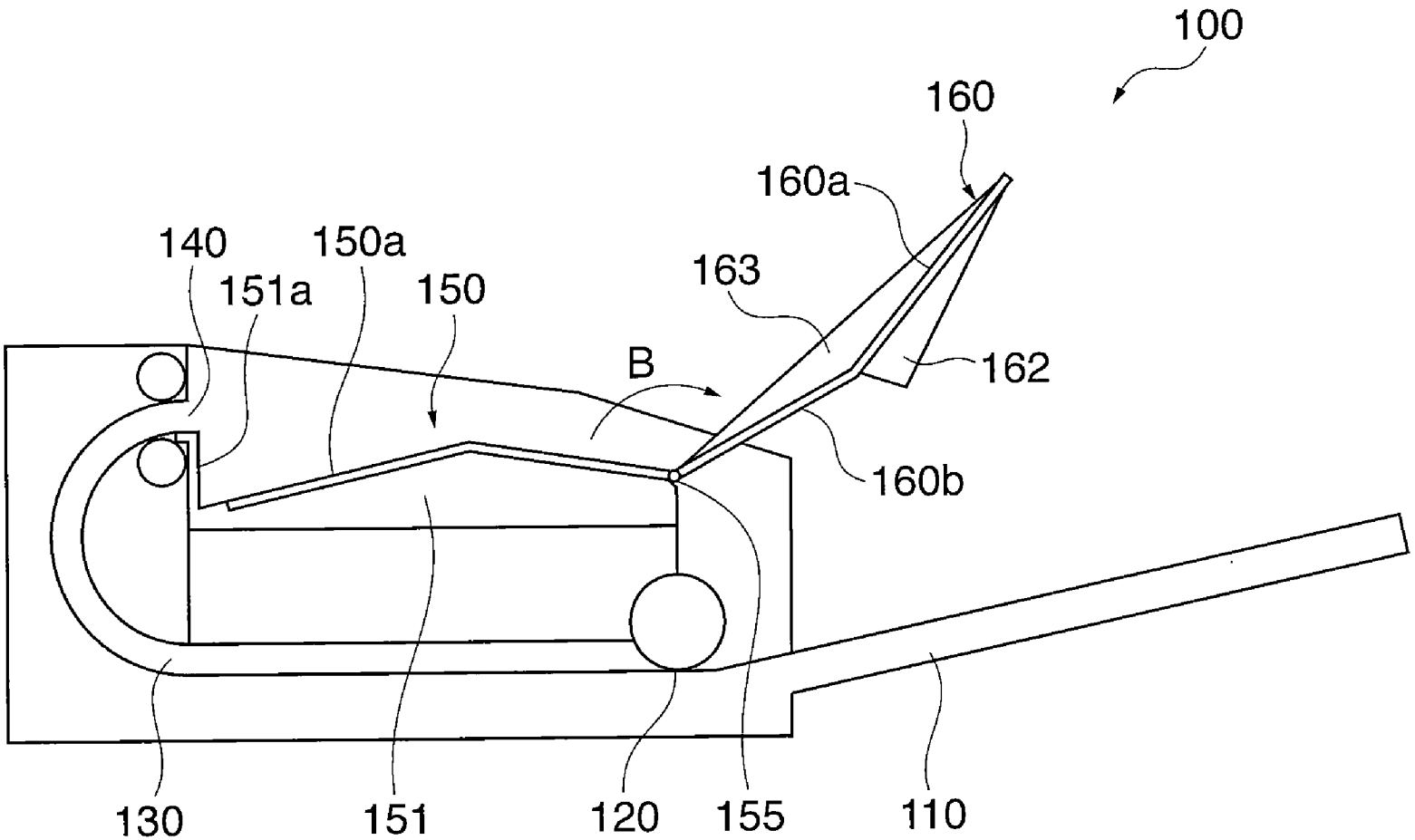
FIG. 6 is a cross-sectional view of the scanner taken on line VI-VI of FIG. 5.
Figure 7:
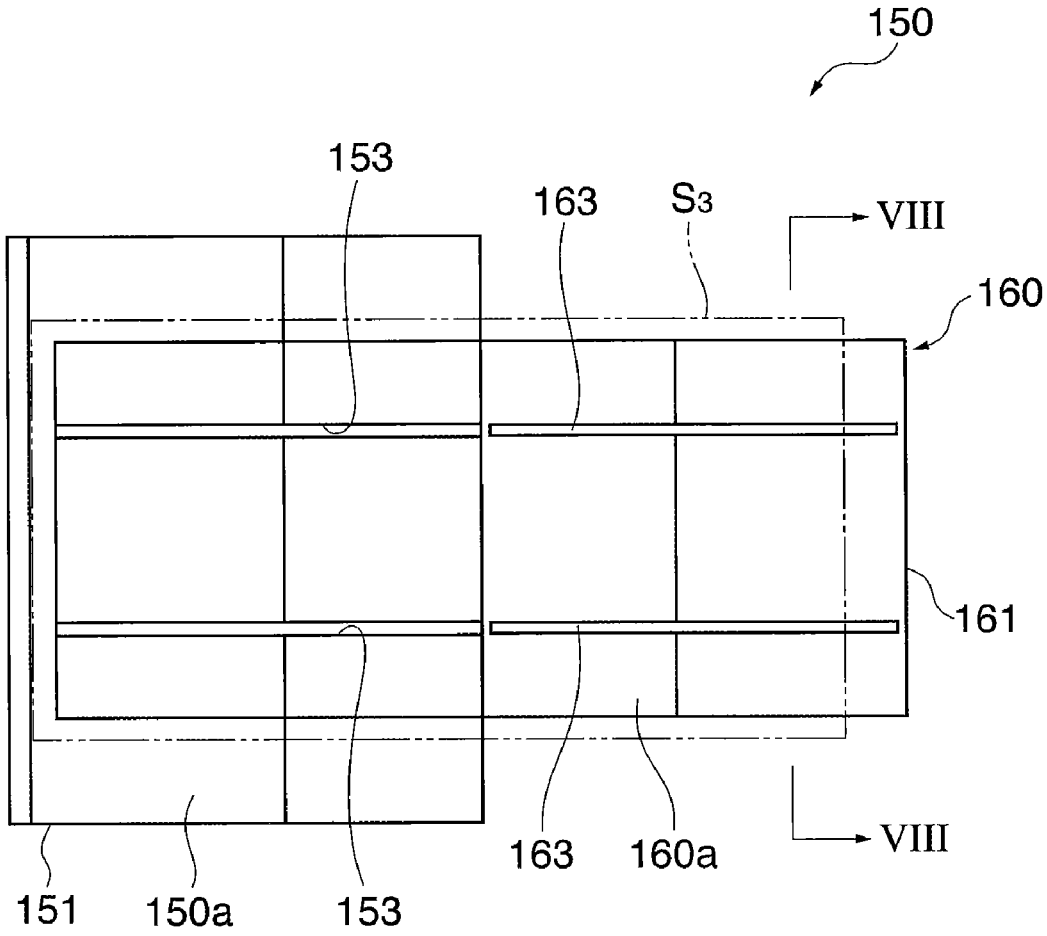
FIG. 7 is a top view of the stacking section of the scanner in the state shown in FIG. 6.

As shown in FIG. 5 to FIG. 7, two ribs 163 that are disposed on the extension stacking surface 160*a* of the base 161 are also provided on the extension tray 160. These ribs 163 can be stored in slits 153 that are formed in the stacking surface 150*a* of the base 151.

Although according to the present embodiment the ribs 163 are formed in a shape that is substantially triangular when viewed from the side, the shape of the ribs is not limited thereto. A feature of the present invention is that the height of the upper end of the ribs 163 is arranged to be lower at the end portion near the sheet discharge section 140 than the height at the discharging direction downstream end portion. Thus, discharged large size sheets $S_3$ are moved towards the sheet discharge section 140 on the base 151 along the sloping surface of the upper end of the ribs 163 by the force of gravity. And the trailing ends of the sheets stacked on the stacking surface 150*a*, the extension stacking surface 160*a*, and the ribs 163 collide against the wall surface 151*a* to thereby align the sheets. It is therefore possible to more surely prevent the sheets $S_3$ on the stacking surface 150*a* and the extension stacking surface 160*a* from being scattered in the discharging direction. Thus the discharging direction alignment of discharged sheets $S_3$ can be improved. Further, since an angle formed between the upper end of the ribs 163 and the horizontal plane is greater than an angle formed between the stacking surface 150*a* and the horizontal plane, a returning force applied to the leading end portion of a sheet is greater than a returning force applied to the trailing end portion of the sheet. Consequently, excellent sheet alignment is achieved by colliding the trailing ends of sheets against the wall surface 151*a*.

In this connection, the larger the angular difference between the extension stacking surface 160*a* and the horizontal plane becomes, the more friction occurs when the leading end of the sheet $S_3$ contacts the extension stacking surface 160*a*. However, with the ribs 163 provided on the extension stacking surface 160*a* the friction acting on the leading end of the sheet $S_3$ can be reduced by reduction of contact area. Further, because the sheets collide with the ribs 163 and deflect, the rigidity of the leading end portion of the sheets increase, and it is therefore possible to prevent the leading ends from curling up.

Preferably, as shown in FIG. 5 and FIG. 6, the extension stacking surface 160*a* can be set to be higher in the vertical direction than at least one portion of the stacking surface 150*a*. Further, one portion of the extension stacking surface 160*a* can be set to be higher than the height in the vertical direction of the sheet discharge section 140. It is thereby possible to surely prevent sheets $S_3$ from scattering when passing over the top of the extension tray 160.

As shown in FIG. 5 and FIG. 7, the two ribs 163 are disposed to be mutually parallel on the extension stacking surface 160*a*. The space between the two ribs 163 is narrower than the width of a large size sheet $S_3$, for example the length of the narrow side of an A3 size sheet. It is therefore possible to surely support the sheet $S_3$ on the top surface of the ribs 163. As a result, the slits 153 for storing the ribs 163 can be easily formed.

Figure 8:
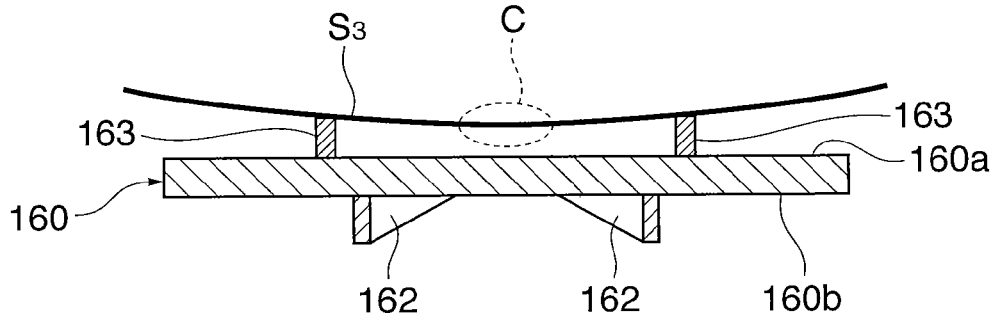
FIG. 8 is a cross-sectional view taken on line VIII-VIII of FIG. 7, showing the state of a sheet stacked on the extension tray when the extension tray is extended to the extension position.
Figure 9:
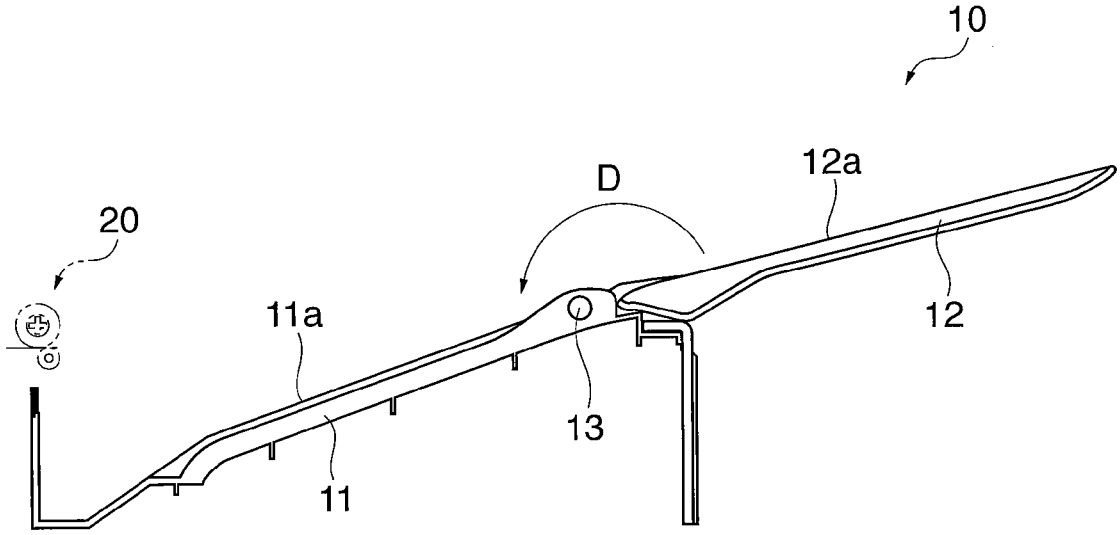
FIG. 9 is a side view showing schematic configuration of a conventional sheet discharge tray.

Thus, when the extension tray 160 is in the extension position, as shown by a region C in FIG. 8, a deflection depending on the space between the two ribs 163 occurs in the center part in the width direction of a sheet $S_3$ that is stacked on the top surface of the ribs 163 of the extension stacking surface 160*a*. The deflection deformation volume differs with respect to the discharging direction. More specifically, the deflection at the leading end in the discharging direction of the sheet $S_3$ is larger than at the trailing end thereof, because the stacking surface 150*a* where the trailing end of the sheet $S_3$ is located has no ribs for supporting the sheet $S_3$. Thus, scattering of the sheets $S_3$ in the width direction is controlled by the upper end portions of the ribs 163 at the leading end of the sheets in the discharging direction in particular. Further, the two side edges of the sheets move towards the center of the sheets because of the deflection. As a result, the width direction alignment of the discharged sheets $S_3$ can be improved. It is therefore possible to reduce the time and labor required of a user to align the sides of a bundle of sheets $S_3$ stacked on the sheet discharge tray.

The discharging direction alignment of the sheets $S_3$ is also assured by the wall surface 151*a* of the base 151.

It is therefore possible to omit the installation of the end fence 33 as an abutment plate and the ribs 35 as widthwise regulating plates as shown in FIG. 10.

As described in detail above, according to the present embodiment, respective ribs 162 and 163 are disposed on the sheet stacking surface 160*b* and the extension stacking surface 160*a* of the extension tray 160. It is thus possible to improve discharging direction alignment and width direction alignment of discharged sheets with a simple configuration. As a result, the time and labor required of a user to align the sides of a bundle of sheets that are stacked on the sheet discharge tray can be reduced.

In this connection, in the above described embodiment, the two ribs 162 are arranged in the substantially divergent layout on the stacking surface 160*b* and the two ribs 163 are arranged in a parallel state on the extension stacking surface 160*a*. The shape of the ribs 162 and 163 can be changed depending on the size of the extension tray 160 or the size of angles that the stacking surfaces 150*a* and 160*b* and the extension stacking surface 160*a* respectively form with the horizontal plane or the like. For example, when the width of the extension tray 160 is larger than the width of the discharged sheet, the ribs 163 may be arranged in the substantially divergent layout on the extension stacking surface 160*a*. Further, the ribs 163 may be arranged in a substantially divergent layout on the extension stacking surface 160*a*, and the ribs 162 may be arranged in parallel on the stacking surface 160*b*. Both the ribs 162 and the ribs 163 may also include both a substantially parallel portion and a substantially divergent portion.

The ribs 162 and 163 may be formed in any shape as long as the shape is one that can be disposed on the base 161.

Figure 3B:
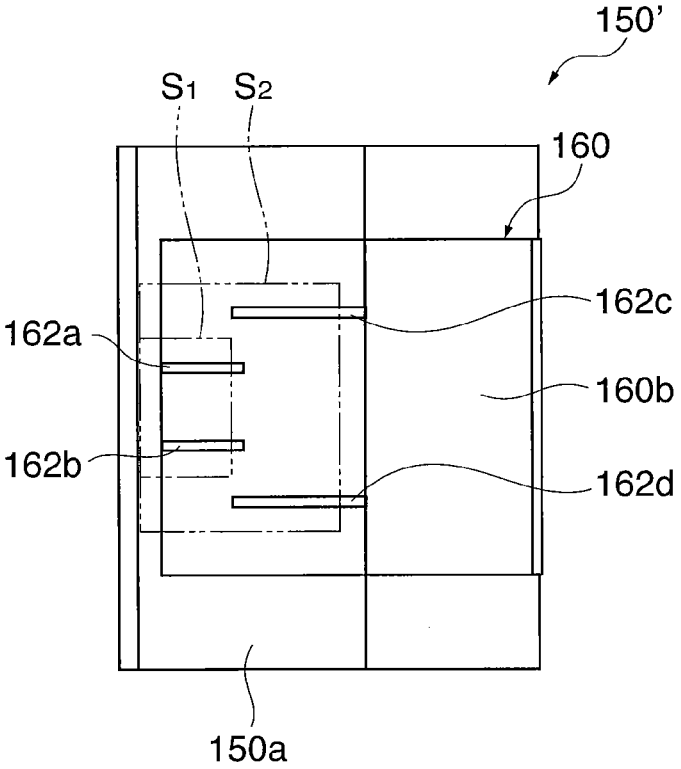
FIG. 3B is a top view of its variation.

Further, although the number of ribs is ideally two as in the above described embodiment, the number of ribs may be more than two. In such case, the spaces between the plurality of ribs or an angle that the upper end of each rib forms with the horizontal plane is determined so that the above described effect can be obtained. For example, as shown in FIG. 3B, a configuration may be adopted in which four ribs 162*a* to 162*d* disposed on stacking surface 160*b* and are elongate substantially in the discharging direction are provided. In this case, the same effect can be obtained by making the space between the two ribs 162*a* and 162*b* near the sheet discharge section 140 narrower than the space between the two ribs 162*c* and 162*d* that are arranged further from the sheet discharge section. The ribs 162*a* and 162*b* need not be parallel, and need not be in the shape of a straight line. Likewise, the ribs 162*c* and 162*d* need not be parallel, and need not be in the shape of a straight line. In such case, the space between the aforementioned ribs is made a space that is determined as an average value.

The upper ends of the ribs 162 and 163 are not limited to a flat surface, and may be a curved surface. Although, the upper ends of the ribs 162 and 163 have preferably a linear shape, they need not have a linear shape. In these cases, an angle formed by the upper ends of the ribs 162 and 163 and the horizontal plane is assumed to be an angle that is obtained as an average value. More specifically, the relevant angle is calculated by regarding the upper ends of the ribs 162 and 163 as linear shapes.

Although the ribs 162 and 163 can be formed in an integrated condition with respect to the base 161, the ribs 162 and 163 may be separate members to the base 161. In this case, the ribs 162 and 163 may be movably disposed on the base 161. The material comprising the ribs 162 and 163 may be any kind of material, and a material can be preferably used that facilitates sliding of sheets at least on the top surface of the ribs 162 and 163.

Further, the stacking surfaces 150*a* and 160*a* need not be a planar shape. In this case, an angle formed with the horizontal plane is assumed to be an angle that is obtained as an average value in the same manner as described above.

Although the sheet discharge tray 150 according to the above described embodiment is provided in an image reading apparatus such as the scanner 100, it may also be provided in an image forming apparatus such as a copying machine, a printer, or a facsimile machine. Further, the sheet discharge tray 150 according to the present invention may be any kind of device as long as it is capable of stacking sheets that are discharged from the conveying section 130 that conveys sheets. Furthermore, in a case where it is sufficient to make the alignment of small size sheets, only the ribs 162 may be provided, and this configuration is included in the present invention. Furthermore, in a case where extension tray 160 is not provided, ribs 162 may be disposed on stacking surface 150*a*, and this configuration is included in the present invention. And when only widthwise alignment is required, the height or the inclination of the upper end of the ribs 162 is not restricted. Those configurations are also included in the present invention.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims priority from Japanese Patent Application No. 2006-249557 filed Sep. 14, 2007, which is hereby incorporated by reference herein in its entirety.

What is claimed is:

1. A sheet discharge tray having a stacking surface adapted to stack sheets that are discharged in a discharging direction from a sheet discharge section of a sheet conveying apparatus adapted to convey sheets, comprising:

an extension tray comprising a plate-shaped member on which is formed an extension stacking surface for extending said stacking surface in said discharging direction;

a pivot adapted to make said extension tray rotatable between a first position at which said extension stacking surface is facing said stacking surface and a second position for extending said stacking surface;

at least two first ribs which are disposed on said extension stacking surface and are elongate substantially in said discharging direction, so as to stack the sheets thereon when said extension tray is at said second position; and at least two second ribs which are disposed on a surface of said extension tray opposite to said extension stacking surface and are elongate substantially in said discharging direction, so as to stack the sheets thereon when said extension tray is at said first position;

wherein, when said extension tray is at said second position, said first ribs are arranged respectively such that an upper end of a discharging direction downstream end portion thereof is higher than an upper end of a discharging direction upstream end portion thereof, whereas, when said extension tray is at said first position, said second ribs are arranged respectively such that an upper end of a discharging direction downstream end portion thereof is higher than an upper end of a discharging direction upstream end portion thereof.

2. The sheet discharge tray according to claim 1, wherein, when said extension tray is at said second position, an angle formed between upper ends of said first ribs and a horizontal plane is greater than an angle formed between said stacking surface and a horizontal plane.

3. The sheet discharge tray according to claim 1, wherein, when said extension tray is at said first position, an angle formed between upper ends of said second ribs and a horizontal plane is greater than an angle formed between said stacking surface and a horizontal plane.

4. A sheet discharge tray having a stacking surface adapted to stack sheets that are discharged in a discharging direction from a sheet discharge section of a sheet conveying apparatus adapted to convey sheets, comprising:

an extension tray comprising a plate-shaped member on which is formed an extension stacking surface for extending said stacking surface in said discharging direction;

a pivot adapted to make said extension tray rotatable between a first position at which said extension stacking surface is facing said stacking surface and a second position for extending said stacking surface;

at least two first ribs which are disposed on said extension stacking surface and are elongate substantially in said discharging direction; and at least two second ribs which are disposed on a surface of said extension tray opposite to said extension stacking surface and are elongate substantially in said discharging direction;

wherein, when said extension tray is at said second position, said first ribs are arranged respectively such that an upper end of a discharging direction downstream end portion thereof is higher than an upper end of a discharging direction upstream end portion thereof, whereas, when said extension tray is at said first position, said second ribs are arranged respectively such that an upper end of a discharging direction downstream end portion thereof is higher than an upper end of a discharging direction upstream end portion thereof; and wherein, when said extension tray is at said first position, a space with respect to a width direction that is orthogonal to said discharging direction between at least a pair of adjacent ribs among said second ribs is narrower at said discharging direction upstream end portion than a space with respect to said width direction between said at least a pair of adjacent ribs at said discharging direction downstream end portion.

5. A sheet discharge tray having a stacking surface adapted to stack sheets that are discharged in a discharging direction from a sheet discharge section of a sheet conveying apparatus adapted to convey sheets, comprising:

an extension tray comprising a plate-shaped member on which is formed an extension stacking surface for extending said stacking surface in said discharging direction;

a pivot adapted to make said extension tray rotatable between a first position at which said extension stacking surface is facing said stacking surface and a second position for extending said stacking surface;

at least two first ribs which are disposed on said extension stacking surface and are elongate substantially in said discharging direction; and at least two second ribs which are disposed on a surface of said extension tray opposite to said extension stacking surface and are elongate substantially in said discharging direction;

wherein, when said extension tray is at said second position, said first ribs are arranged respectively such that an upper end of a discharging direction downstream end portion thereof is higher than an upper end of a discharging direction upstream end portion thereof, whereas, when said extension tray is at said first position, said second ribs are arranged respectively such that an upper end of a discharging direction downstream end portion thereof is higher than an upper end of a discharging direction upstream end portion thereof, and wherein, when said extension tray is at said second position, a space with respect to a width direction that is orthogonal to said discharging direction between at least a pair of adjacent ribs among said first ribs is narrower at said discharging direction upstream end portion than a space with respect to said width direction between said at least a pair of adjacent ribs at said discharging direction downstream end portion.

6. The sheet discharge tray according to claim 1, wherein at least one portion of said extension tray is configured to be storable in a base on which said stacking surface is formed.

7. A sheet discharge tray having a stacking surface adapted to stack sheets that are discharged in a discharging direction from a sheet discharge section of a sheet conveying apparatus adapted to convey sheets, comprising:

an extension tray comprising a plate-shaped member on which is formed an extension stacking surface for extending said stacking surface in said discharging direction;

a pivot adapted to make said extension tray rotatable between a first position at which said extension stacking surface is facing said stacking surface and a second position for extending said stacking surface;

at least two first ribs which are disposed on said extension stacking surface and are elongate substantially in said discharging direction; and at least two second ribs which are disposed on a surface of said extension tray opposite to said extension stacking surface and are elongate substantially in said discharging direction;

wherein, when said extension tray is at said second position, said first ribs are arranged respectively such that an upper end of a discharging direction downstream end portion thereof is higher than an upper end of a discharging direction upstream end portion thereof, whereas, when said extension tray is at said first position, said second ribs are arranged respectively such that an upper end of a discharging direction downstream end portion thereof is higher than an upper end of a discharging direction upstream end portion thereof, and wherein said first ribs are configured to be storable in slits that are formed in said base.

8. A sheet discharge tray having a stacking surface adapted to stack sheets that are discharged in a discharging direction from a sheet discharge section of a sheet conveying apparatus adapted to convey sheets, comprising:

an extension tray comprising a plate-shaped member on which is formed an extension stacking surface for extending said stacking surface in said discharging direction;

a pivot adapted to make said extension tray rotatable between a first position at which said extension stacking surface is facing said stacking surface and a second position for extending said stacking surface;

at least two first ribs which are disposed on said extension stacking surface and are elongate substantially in said discharging direction; and at least two second ribs which are disposed on a surface of said extension tray opposite to said extension stacking surface and are elongate substantially in said discharging direction;

wherein, when said extension tray is at said second position, said first ribs are arranged respectively such that an upper end of a discharging direction downstream end portion thereof is higher than an upper end of a discharging direction upstream end portion thereof, whereas, when said extension tray is at said first position, said second ribs are arranged respectively such that an upper end of a discharging direction downstream end portion thereof is higher than an upper end of a discharging direction upstream end portion thereof, and wherein, when said extension tray is at said first position, said second ribs comprise at least two pairs of ribs consisting of first pair of ribs and second pair of ribs located at a location closer to a discharging direction downstream end portion of said surface of said extension tray than a location of said first pair of ribs, and a space between said first pair of ribs with respect to a width direction that is orthogonal to said discharging direction is narrower than a space between said second pair of ribs.

9. A sheet conveying apparatus comprising a sheet discharge tray according to any one of claims 1 to 8.

10. An image forming apparatus comprising a sheet discharge tray according to any one of claims 1 to 8.

11. An image reading apparatus comprising a sheet discharge tray according to any one of claims 1 to 8.

12. The sheet discharge tray according to claim 1, wherein, when said extension tray is at said first position, said at least two second ribs are located at a location near a discharging direction upstream end portion of said surface of said extension tray.

* * * * *